United States Patent [19]

Fujisawa et al.

[11] Patent Number: 4,480,545

[45] Date of Patent: Nov. 6, 1984

[54] OFFSET PRESS HAVING TWO PRINTING UNITS WITH ALTERNATE PATH DELIVERY CYLINDERS

[75] Inventors: Nobuhiko Fujisawa; Shozo Tanibe; Tatsunori Hujiki, all of Hiroshima, Japan

[73] Assignee: Ryobi Ltd., Hiroshima, Japan

[21] Appl. No.: 502,062

[22] Filed: Jun. 7, 1983

[30] Foreign Application Priority Data

Jun. 8, 1982 [JP] Japan ..... 57-98881

[51] Int. Cl.[3] ..... B41F 5/16

[52] U.S. Cl. ..... 101/183; 271/82; 271/314; 101/248; 101/72

[58] Field of Search ..... 101/183–184, 101/217–218, 229, 231–232, 246–249, 152–153, 216, 72; 271/314, 82

[56] References Cited

U.S. PATENT DOCUMENTS

| | | | |
|---|---|---|---|
| 3,384,011 | 5/1968 | Bolza-Schunemann | 101/229 X |
| 3,443,808 | 5/1969 | Siebke | 271/82 |
| 3,847,077 | 11/1974 | Zirnstein et al. | 101/183 X |
| 3,926,118 | 12/1975 | Preuss | 101/246 |
| 4,015,522 | 4/1977 | Preuss et al. | 101/183 |
| 4,018,161 | 4/1977 | Johne | 271/82 |
| 4,060,238 | 11/1977 | Simeth | 271/314 |
| 4,217,823 | 8/1980 | Burger | 101/248 |
| 4,218,972 | 8/1980 | Fujishiro | 101/184 X |
| 4,222,326 | 9/1980 | Mathes et al. | 101/183 |
| 4,409,895 | 10/1983 | Fischer | 101/183 |

FOREIGN PATENT DOCUMENTS

| | | | |
|---|---|---|---|
| 2314302 | 9/1974 | Fed. Rep. of Germany | 101/183 |

*Primary Examiner*—E. H. Eickholt

*Attorney, Agent, or Firm*—Sughrue, Mion, Zinn, Macpeak & Seas

[57] ABSTRACT

An offset press is provided with two printing units, the first of which is a typical offset unit and the second of which is adapted to effect number printing, relief printing or perforation or the like. The second printing unit is provided with a printing cylinder, a paper ejection cylinder and first and second delivery cylinders whose axes are positioned at the four corners of a square. In this manner, the paper from the first printing unit can be guided to the paper ejection cylinder by two distinct selectible transport paths, only one of which includes the second printing unit's printing cylinder.

8 Claims, 5 Drawing Figures

OFFSET PRESS HAVING TWO PRINTING UNITS WITH ALTERNATE PATH DELIVERY CYLINDERS

BACKGROUND OF THE INVENTION

This invention relates to an offset press having two printing units. More particularly, it is concerned with an offset press comprising a printing unit for ordinary offset printing, and a printing unit including a delivery cylinder positioned adjacent to an impression cylinder in the ordinary offset printing unit, and a number printing cylinder.

In addition to the press of the type mentioned above, there are known two types of presses adapted for both ordinary offset printing and number printing, i.e., one of the type having an impression cylinder for ordinary printing and one of the type including a chain delivery section. These types of presses are different from the first-mentioned type in that a transverse perforation cylinder can be included in the first-mentioned type to enable simultaneous number printing and perforation. An impression cylinder for ordinary printing is not liable to be damaged, as opposed to the type in which another cylinder also serves as an impression cylinder; therefore, no adverse effect is produced on the quality of ordinary printing. It is reliable and efficient in operation, and enables number printing, etc. on the paper held on the impression cylinder. It is an ideal type of press having a number of advantages, including high accuracy of registration.

The conventional press of the type in question has a number printing unit defined by an impression cylinder for ordinary printing, a delivery cylinder, a number printing cylinder and a paper ejection cylinder disposed in that order. If number printing, perforation or resin relief printing is performed, no problem arises, since the printing paper is held against the number printing cylinder. If no number printing or the like is performed, however, the curved trailing edge of the paper rises above the cylinder surface during its travel, and there is every likelihood that the printed surface of the paper may be brought into contact with, and scratched by, objects around the number printing cylinder. This trouble is particularly likely to occur with thick or rigid printing papers which have a greater tendency to curve at the trailing edge.

SUMMARY OF THE INVENTION

This invention provides a novel press having two printing units in order to solve the problems of the prior art as hereinabove pointed out. It is an object of this invention to provide a shorter path for the paper when no number printing is performed, and to prevent scratching of the printing surfaces which would otherwise result from the curvature of the trailing edge. This object is attained by a press comprising a first printing unit for ordinary printing and a second printing unit for number printing. The second printing unit comprises a number printing cylinder, a paper ejection cylinder, and first and second delivery cylinders. If number printing is performed, the printing paper is transported past the number printing cylinder after transfer from an impression cylinder in the first printing unit to the first delivery cylinder, while the paper is transferred from the first delivery cylinder to the second delivery cylinder if no number printing is required. These two paths for the transportation of printing paper are, therefore, selectively employed.

DETAILED DESCRIPTION OF THE PREFERRED EMBODIMENTS

Figure 1:
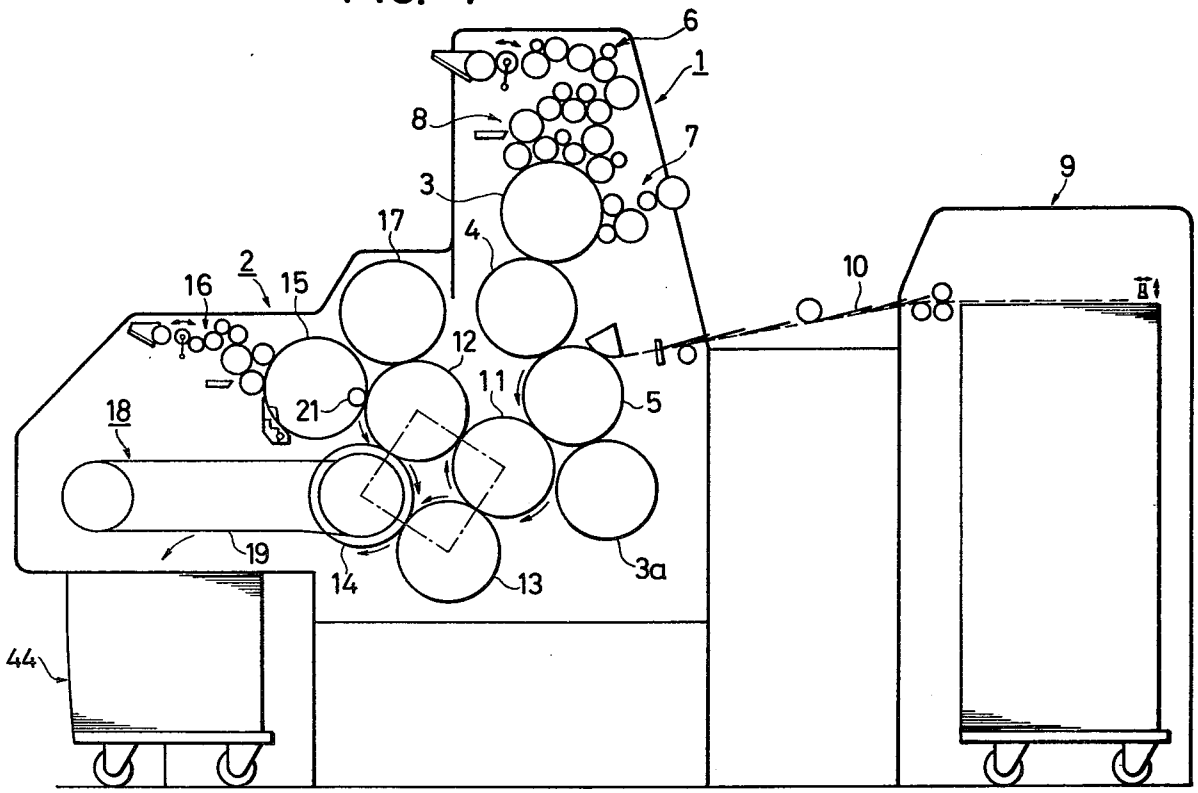
FIG. 1 is a schematic side elevational view of an offset press having two printing units according to this invention.

The invention will now be described in detail by way of example with reference to the attached drawings. Referring to FIG. 1, a press embodying this invention comprises a first printing unit 1 for ordinary printing, and a second printing unit 2 for number printing.

Figure 3:
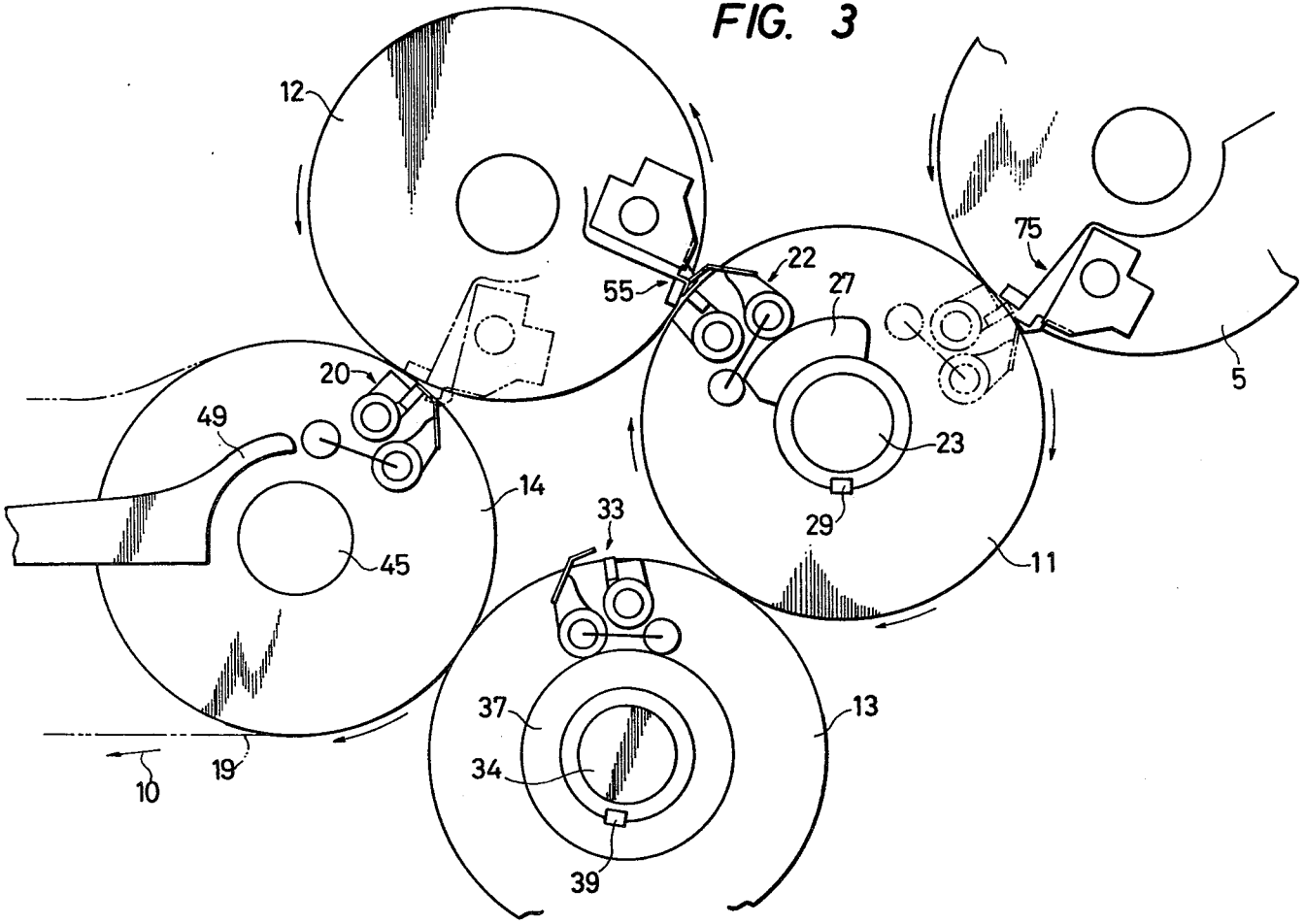
FIGS. 3 and 4 are side elevational views showing the relationship between the cams and paper catching pawls in the second printing unit when the cams have been actuated to define paths for the printing paper about the number printing cylinder, and about the second delivery cylinder, respectively.
Figure 4:
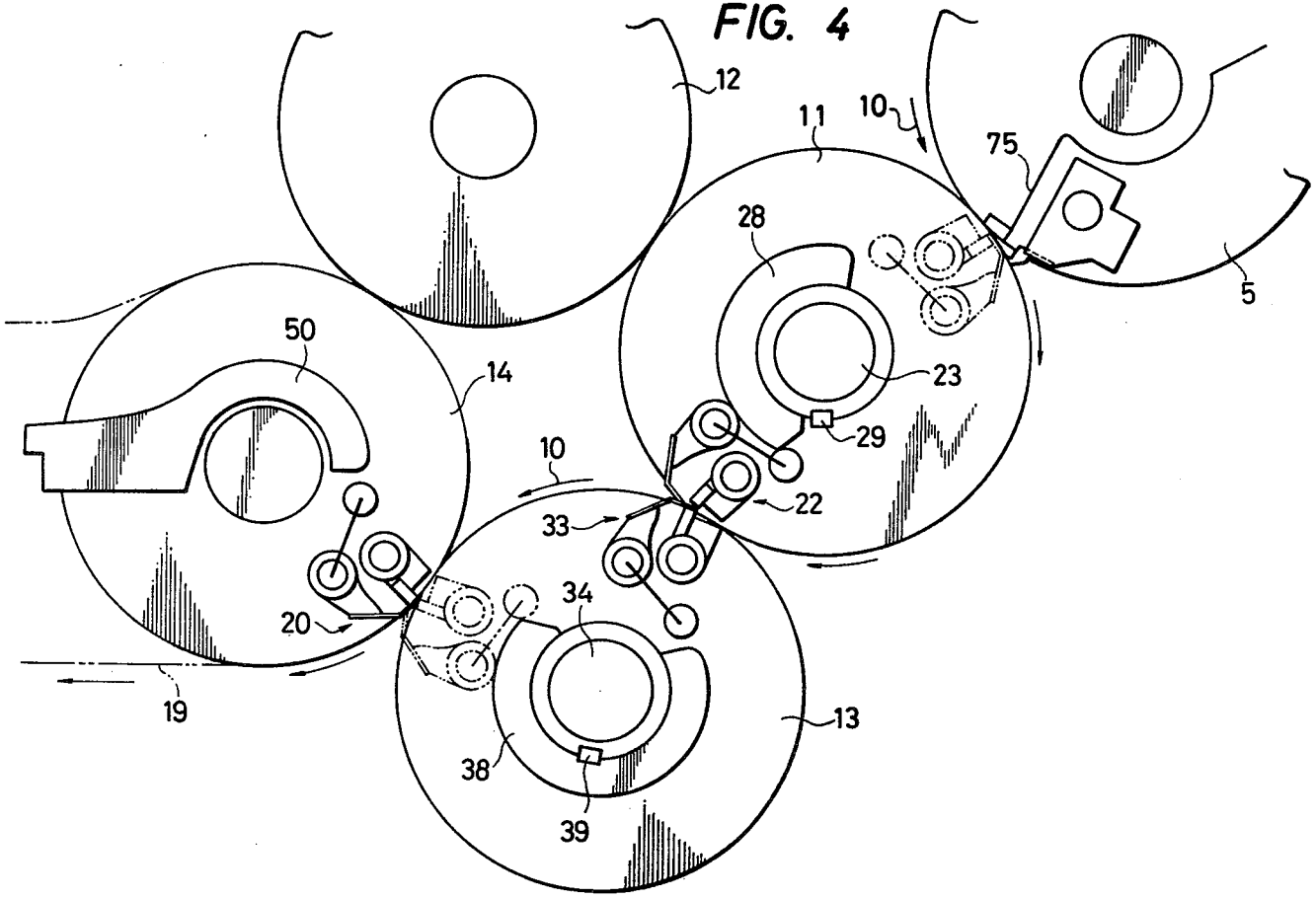

The first printing unit 1 comprises a plate cylinder 3, a rubber cylinder 4 and an impression cylinder 5 in the case of a single-sided press, and further includes a second plate cylinder 3*a* in the case of a perfecting press. The press further includes an inking device 6, a moistening device 7 and a roller cleaning device 8, whether it is of the single-sided printing or perfecting type. A sheet of printing paper 10 is supplied from a paper feeder 9 into the nip between the rubber cylinder 4 and the impression cylinder 5 for ordinary printing using the ink transferred onto the rubber cylinder 4. A paper catching pawl 75 is provided in the impression cylinder 5 as shown in FIGS. 3 and 4 for conveying the printing paper to a first delivery cylinder in the second printing unit which will hereinafter be described. No further description of the first printing unit 1 is believed necessary, since it does not differ from its counterpart in any conventional press.

The second printing unit 2 is disposed between the impression cylinder 5 in the first printing unit 1 and a paper ejection device 18. It essentially comprises the first delivery cylinder 11, a number printing cylinder 12, a second delivery cylinder 13, a paper ejection cylinder 14, a number affixing cylinder 15 and an inking device 16, as shown in FIG. 1.

It is easy to provide the second printing unit 2 with a transverse perforation cylinder 17 facing the number printing cylinder 12, as shown in the drawings.

The paper ejection device 18 comprises the paper ejection cylinder 14, a paper ejection chain 19, and a paper catching pawl 20 for paper ejection (FIG. 3) attached to the chain 19.

The first and second delivery cylinders 11 and 13, the number printing cylinder 12 and the paper ejection cylinder 14 in the second printing unit 2 are so positioned that an imaginary line joining the axes of those cylinders forms a square.

The first delivery cylinder 11 is provided for delivering, to either the number printing cylinder 12 or the second delivery cylinder 13, the printing paper 10 printed by the first printing unit 1. The second delivery cylinder 13 is provided for receiving the printing paper 10 from the first delivery cylinder 11 and transferring it to the paper catching pawl 20 passing over the paper ejection cylinder 14, when no number printing is required.

The number printing cylinder 12 provides a support for the printing paper 10 when number printing is required thereon, or when perforation is effected by the transverse perforation cylinder 17 or a longitudinal perforation blade 21.

Figure 2:
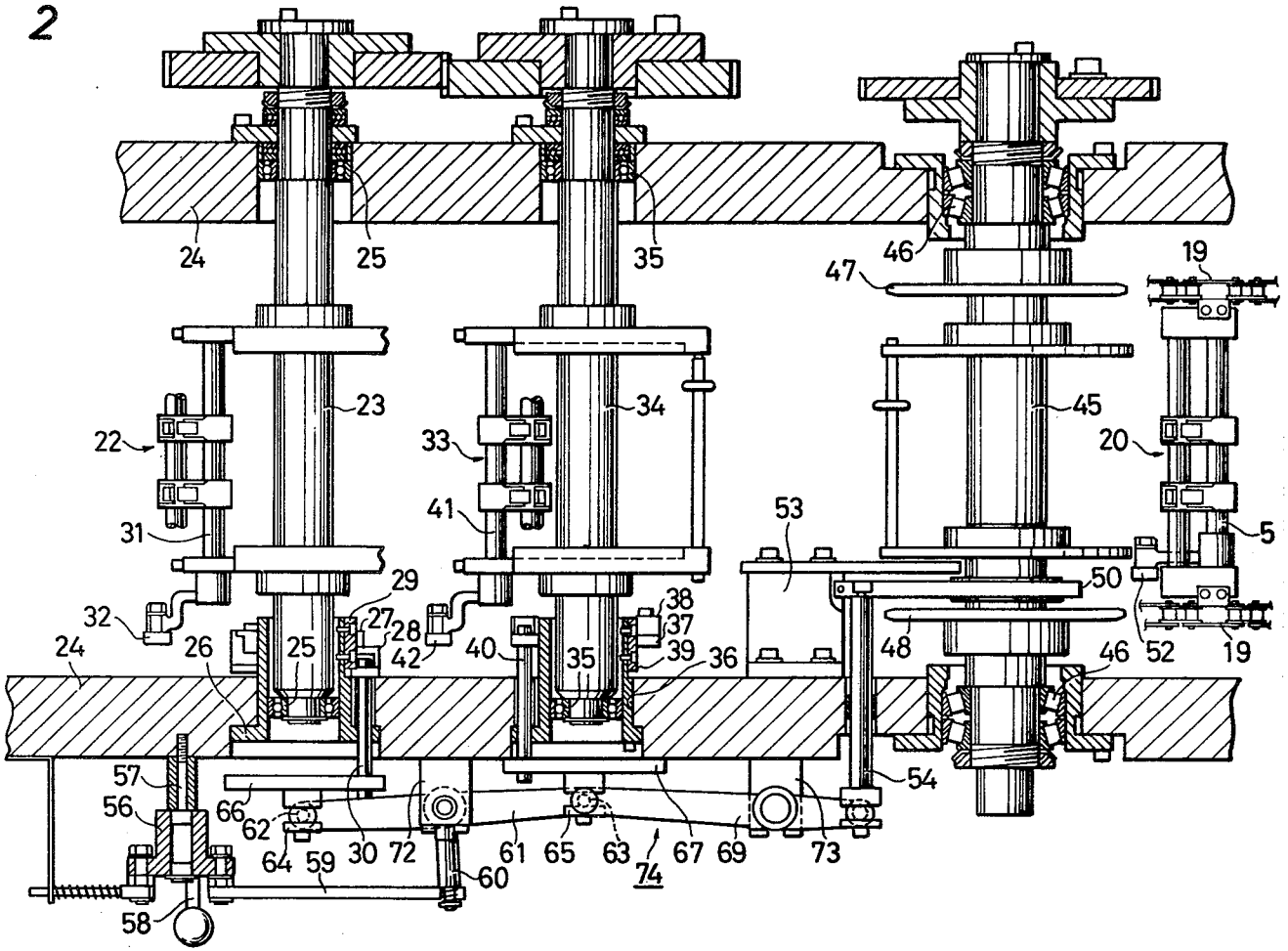
FIG. 2 is a top plan view, partly in longitudinal section, of the cylinders in the second printing unit, and the cams and the cam changeover mechanism.

The first delivery cylinder 11 includes a catching pawl 22 supported on a cylinder shaft 23 for catching the leading edge of the printing paper 10 and transferring it to either the number printing cylinder 12 or the second delivery cylinder 13, as shown in FIGS. 2 to 4. The cylinder shaft 23 is rotatably supported on frames 24 by bearings 25. A bearing housing 26 is secured to one of the frames 24 at one end of the shaft 23. Cams 27 and 28 are keyed to the outer periphery of the hearing housing 26 slidably, but nonrotatably.

The cams 27 and 28 are secured in intimate contact with each other, and are slidable along the cylinder shaft by a cam changeover mechanism to which they are connected by a slide bar 30, as will hereinafter be described in further detail.

The cams 27 or 28 selectively act on a cam follower 32 supported rotatably on a shaft 31 for actuating the paper catching pawl 22 to thereby transfer the printing paper 10 from the impression cylinder 5 to either the number printing cylinder 12 or the second delivery cylinder 13.

If the cams 27 and 28 are moved by the cam changeover mechanism to the position shown in FIG. 2, the cam follower 32 is brought into contact with the cam 27 to actuate the catching pawl 22 to transfer the printing paper 10 from the impression cylinder 5 to the first delivery cylinder 11 and the number printing cylinder 12. The relationship between the cam 27 and the catching pawl 22 is shown in FIG. 3.

If the cams 27 and 28 are pushed inwardly away from the frame 24 by the cam changeover mechanism, the cam follower 32 is brought into contact with the cam 28 to actuate the catching pawl 22 so that the printing paper 10 may be transferred from the impression cylinder 5 to the first and second delivery cylinders 11 and 13. The relationship between the cam 28 and the catching pawl 22 is shown in FIG. 4.

The second delivery cylinder 13 receives the printed paper 10 from the first delivery cylinder 11, and transfers it to the paper catching pawl 20 passing through the paper ejection cylinder 14, as already stated. No number printing is effected, as the paper 10 is not passed to the number printing cylinder 12. If, on the contrary, the cam changeover mechanism is actuated to transfer the printing paper 10 from the first delivery cylinder 11 to the number printing cylinder 12, the second delivery cylinder 13 is placed in its inoperative position, as the paper 10 does not pass thereabout.

The second delivery cylinder 13 has a cylinder shaft 34 to which a paper catching pawl 33 is attached for catching the leading edge of the printing paper 10 and transferring it to the paper ejection cylinder 14, as shown in FIG. 2. The shaft 34 is rotatably supported on the frames 24 by bearings 35. A bearing housing 36 is secured to one of the frames 24 at one end of the cylinder shaft 34. Cams 37 and 38 are keyed to the outer periphery of the housing 36 slidably, but non-rotatably.

The cams 37 and 38 are secured in intimate contact with each other, and are slidable along the cylinder shaft by the cam changeover mechanism, to which they are connected by a slide bar 40, as will hereinafter be described in further detail. The cams 37 or 38 selectively act on a cam follower 42 supported rotatably on a shaft 41 for actuating the paper catching pawl 33 to thereby transfer the paper 10 from the first delivery cylinder 11 to the paper ejection cylinder 14, or to place the second delivery cylinder 13 in an idle operation without receiving the paper 10 from the first delivery cylinder 11, to pass it to the number printing cylinder 12.

If the cams 37 and 38 are pushed inwardly by the cam changeover mechanism as shown in FIG. 2, the cam follower 42 is brought into contact with the cam 37 to hold the catching pawl 33 in its open position so that the second delivery cylinder 13 may be placed in an idle operation without any transfer of printing paper thereto. The relationship between the cam 37 and the paper catching pawl 33 is shown in FIG. 3.

If the cams 37 and 38 are moved to the opposite position by the cam changeover mechanism, the cam follower 42 is brought into contact with the cam 38 to close the paper catching pawl 33 so that the printing paper 10 may be transferred from the first delivery cylinder 11 to the paper ejection cylinder 14. The relationship between the cam 38 and the pawl 33 is shown in FIG. 4.

The paper catching pawl 20, which is attached to the chain 19 in the paper ejection device 18, receives the paper 10 from the number printing cylinder 12 or the second delivery cylinder 13 at the paper ejection cylinder 14 to transfer it to a paper ejection table 44 as shown in FIG. 1.

A paper ejection cylinder shaft 45 is rotatably supported on the frames 24 by bearings 46, as shown in FIG. 2. Sprockets 47 and 48 are secured to the shaft 45, and the chain 19 extends about the sprockets 47 and 48. Cams 49 and 50 are provided at one end of the shaft 45.

The cam 49 is secured by a bracket 53 to the frame 24, and is positioned in a location where it can be brought into contact with a cam follower 52 supported rotatably on a shaft 51 for actuating the paper catching pawl 20. The cam 50 is supported by a slide bar 54 which is axially slidable by means of the cam changeover mechanism, as will hereinafter be described in further detail.

If the cam 50 is moved in one direction by the cam changeover mechanism as shown in FIG. 2, the cam 49 is brought into contact with the cam follower 52 to actuate the paper catching pawl 20 so that the paper 10 may be received from the number printing cylinder 12 and transferred to the paper ejection table 44. The relationship between the cam 49 and the cam follower 52 is shown in FIG. 3. If the cam 50 is moved in the opposite direction by the cam changeover mechanism, the cam follower 52 is brought into contact with the cam 50 to actuate the paper catching pawl 20 so that the printing paper 10 may be received from the second delivery cylinder 13 and transferred to the paper ejection table 44. The relationship between the cam 50 and the cam follower 52 is shown in FIG. 4.

The number printing cylinder 12 is provided with a paper catching pawl 55 which is actuated by cams and a cam follower (not shown), as shown in FIG. 3. It is adapted to transfer the printing paper 10 from the first delivery cylinder 11 to the paper ejection cylinder 14. During this transfer, jobs such as number printing, perforation and resin relief printing are carried out.

The cams 27 and 28 on the first delivery cylinder 11, the cams 37 and 38 on the second delivery cylinder 13 and the cam 50 on the paper ejection cylinder 14 must, thus, be moved appropriately. A cam combination composed of one of the two cams on each of these cylinders, i.e., the cams 27, 37 and 49, enables the transfer of the printing paper 10 from the first delivery cylinder 11 to the number printing cylinder 12 and then to the paper ejection cylinder 14 as shown in FIG. 3, while another cam combination composed of the others of the cam pairs, i.e., the cams 28, 38 and 50, effects the transfer of the paper 10 from the first delivery cylinder 11 to the second delivery cylinder 13 and then to the paper ejection cylinder 14, as shown in FIG. 4.

The cams on these cylinders are simultaneously moved by the cam changeover mechanism 74 to enable selection between the two paths for the transfer of the printing paper 10. The cam changeover mechanism 74 is constructed as will hereinafter be described.

Figure 5:
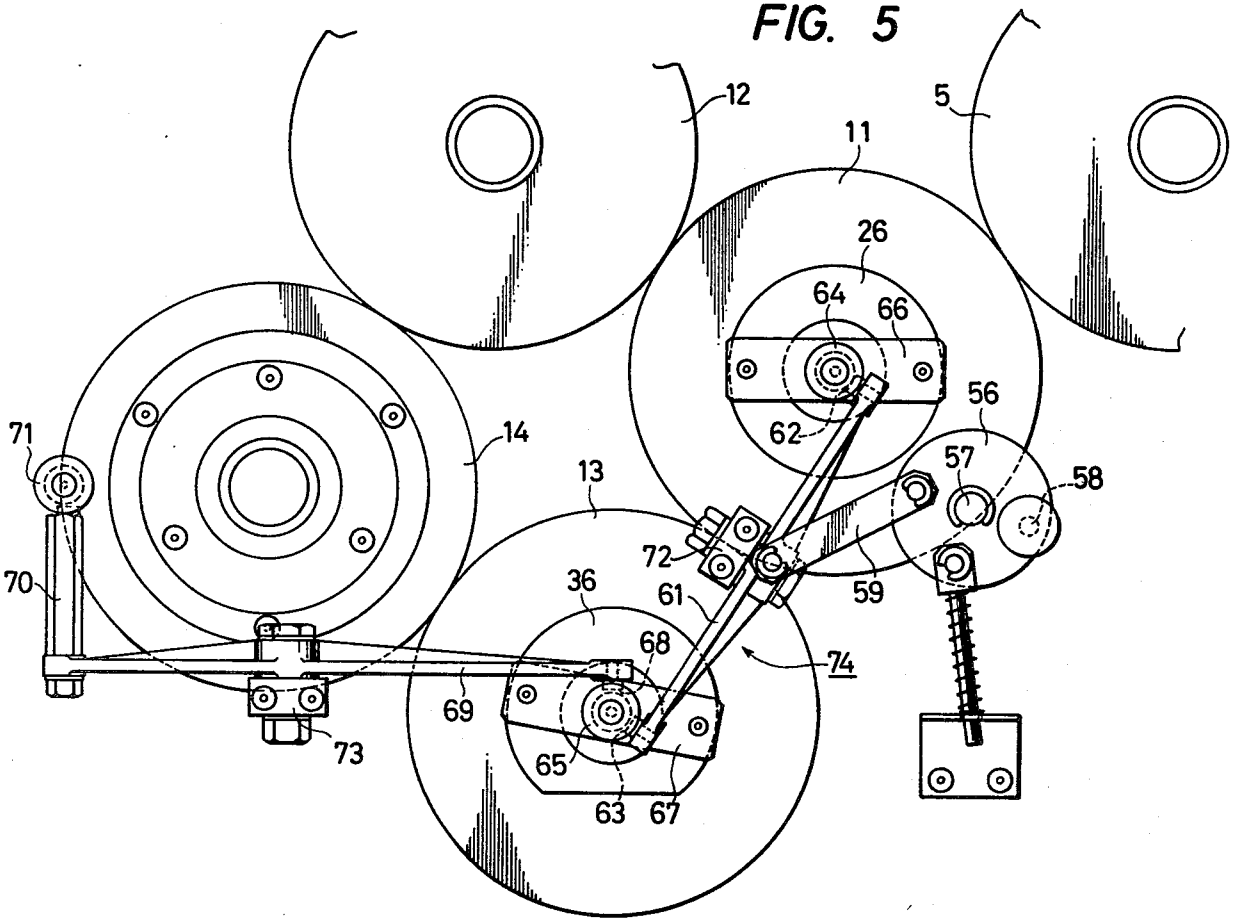
FIG. 5 is a side elevational view of the cam changeover mechanism in the second printing unit.

An arm 56 is rotatably supported on a stud 57 as shown in FIGS. 2 and 5, and the arm 56 is rotatable by means of an operating lever 58. An arm 61 is connected to the arm 56 by a link 59 and an arm 60. The arm 61 is rotatably supported on a stud 72 extending from the frame 24. Pins 62 and 63 are secured to the opposite ends of the arm 61, and pin followers 64 and 65 are provided for following the movement of the arm 61. The pin follower 64 enables the sliding motion of the cams 27 and 28 through a slide plate 66 and the slide bar 30. Likewise, the movement of the pin follower 65 is transmitted to the cams 37 and 38 through a slide plate 67 and the slide bar 40 to cause the sliding motion of the cams 37 and 38. The movement of the pin follower 65 is also transmitted to the cam 50 through a pin 68, an arm 69, a stud 70, a pin follower 71 and a slide bar 54 to actuate the cam 50. The arm 69 is rotatably supported on a stud 73 extending from the frame 24.

The cams on the respective cylinders are, therefore, moved simultaneously if the operating lever 58 is turned.

In FIGS. 3 and 4 showing the two alternative paths for the transfer of the paper 10, the relative positions of the paper catching pawls in relation to time are neglected for the convenience of illustration as to the delivery of the printing paper.

In the printing machine of this invention having two printing units, the second printing unit 2 for number printing comprises the number printing cylinder 12, the paper ejection cylinder 14 and the first and second delivery cylinders 11 and 13, and the cylinders 11 to 14 have their axes situated at the four corners, respectively, of a square, so that two alternative paths are made available for the transfer of the printing paper 10 either past the number printing cylinder 12 when number printing is required, or past the second delivery cylinder 13 when no number printing is required, as hereinabove set forth. If no number printing, resin relief printing or perforation is required, therefore, the printing paper 10 can be transferred directly to the paper ejection device through the second delivery cylinder 13 without passing about the number printing cylinder 12. This transfer prevents any scratching of the printed surface that would otherwise be likely to occur.

As the axes of the cylinders 11 to 14 are located at the four corners, respectively, of a square, the two alternative paths for the transfer of the printing paper have a difference of 360°, and therefore, no positional adjustment of the paper catching pawls is required for the changeover of the two paths. This changeover can thus be accomplished by a single lever easily and very quickly. This feature contributes greatly to the efficiency of the printing operation of the achievement of improved printing quality.

The second printing unit 2 is not limited to number printing, but is also applicable to ordinary offset printing, or relief printing.

What is claimed is:

1. An offset press, comprising; a first printing unit and a second printing unit, said first printing unit comprising a plate cylinder, a blanket cylinder and an impression cylinder, said second printing unit comprising a printing cylinder, a paper delivery cylinder and first and second transfer cylinders, said cylinders of said second printing unit having their axes located at the four corners, respectively, of a square, said printing and second transfer cylinders defining alternative transport paths for the printing paper.

2. An offset press, comprising; a first printing unit and a second printing unit, said first printing unit comprising a plate cylinder, a blanket cylinder and an impression cylinder, said second printing unit comprising a printing cylinder, a paper delivery cylinder and first and second transfer cylinders, said cylinders of said second printing unit having their axes located at the four corners, respectively, of a square, said printing and second transfer cylinders defining two alternative transport paths for printing paper, each of said printing first and second transfer, and paper delivery cylinders having paper gripping means, cam means for actuating said gripping means to effect the transportation of said printing paper via said printing cylinder, and cam means for actuating said gripping means to effect the transfer of said printing paper to said delivery cylinder via said second transfer cylinder, said cam means being operable by a changeover mechanism to select one of said two transport paths.

3. An apparatus as claimed in claim 1, each of said cylinders of said second printing unit including means for gripping the leading edge of the printing paper for transporting the same, said gripping means being actuated by control means so as to selectively transport the printing paper along said alternative transport paths.

4. An apparatus as claimed in claim 3, a first of said alternative transport paths passing via said printing cylinder to said paper delivery cylinder, and a second of said alternative transport paths passing via said second transfer cylinder to said paper delivery cylinder.

5. An apparatus as claimed in claim 4, wherein said gripping means comprise paper gripper, and said control means comprises cam means for selectively controlling the actuation and timing of said gripper, to control the selection between said first and second transport paths.

6. An apparatus as claimed in claim 5, said cam means comprising pairs of cams respectively associated with shafts supporting said first and second delivery cylinders and said paper delivery cylinder, respectively, and means for selectively engaging ones of said pairs of cams with respective cam follower means for actuating the grippers associated therewith.

7. An apparatus as claimed in claim 6, said pairs of cams each including at least one axially slidable cam selectively engageable with the associated cam follower, and means for axially slidably actuating said cams.

8. An apparatus as claimed in claim 7, said means for actuating said cams comprising operating lever means movable between at least first and second positions, and a mechanical linkage between each of said slidable cams and said operating lever means for translating the movement of said operating lever means into an axial cam movement.

* * * * *